US012235059B2

(12) United States Patent
Lu et al.

(10) Patent No.: US 12,235,059 B2
(45) Date of Patent: Feb. 25, 2025

(54) BIOMETRIC FIREARM TRIGGER LOCK WITH ALARM

(71) Applicants: Peng Lu, Surrey (CA); Ruibin Lu, Surrey (CA)

(72) Inventors: Peng Lu, Surrey (CA); Ruibin Lu, Surrey (CA)

( * ) Notice: Subject to any disclaimer, the term of this patent is extended or adjusted under 35 U.S.C. 154(b) by 112 days.

(21) Appl. No.: 17/984,436

(22) Filed: Nov. 10, 2022

(65) Prior Publication Data

US 2024/0159486 A1 May 16, 2024

(51) Int. Cl.
*F41A 17/06* (2006.01)
*F41A 17/46* (2006.01)

(52) U.S. Cl.
CPC ..... *F41A 17/066* (2013.01); *F41A 17/46* (2013.01)

(58) Field of Classification Search
CPC ..... F41A 17/066; F41A 17/46; F41A 17/54
USPC ..... 42/70.06, 70.07
See application file for complete search history.

(56) References Cited

U.S. PATENT DOCUMENTS 5,638,627 A * 6/1997 Klein ..... F41A 17/54 42/70.07
6,874,265 B1 * 4/2005 Pathak ..... F41A 17/066 42/70.07
10,852,089 B1 * 12/2020 Ramirez Navarrete ..... F41A 17/066
2013/0312306 A1 * 11/2013 Ruffin ..... F41A 17/44 42/70.07
2014/0215882 A1 * 8/2014 Milde, Jr. ..... F41A 17/54 42/70.06
2018/0031345 A1 2/2018 Winiecki
2020/0049439 A1 * 2/2020 Thompson ..... F41A 17/066

FOREIGN PATENT DOCUMENTS

| | | | |
|---|---|---|---|
| CN | 203928868 | U | 11/2014 |
| CN | 105333768 | A | 2/2016 |
| CN | 107764127 | A | 3/2018 |
| CN | 207144670 | U | 3/2018 |
| CN | 110159102 | A | 8/2019 |
| CN | 111456562 | A | 7/2020 |
| CN | 114421626 | A | 4/2022 |
| CN | 216406436 | U | 4/2022 |

OTHER PUBLICATIONS

Examiner's Report issued by the Canadian Intellectual Property Office regarding Canadian patent application No. 3,214,647, dated May 22, 2024. The Examiner is Anton Lebar.

* cited by examiner

*Primary Examiner* — Bret Hayes
(74) *Attorney, Agent, or Firm* — Lei Gao

(57) ABSTRACT

This disclosure provides a trigger lock system that includes a trigger lock that collects a fingerprint and unlocks when the fingerprint matches a stored fingerprint. The trigger lock includes a wireless communication module, for example, Bluetooth module and a Thread module, such that it can connect to a user device by Bluetooth or internet through a Thread router. The trigger lock may be unlocked remotely by sending a command from the user device. The trigger lock may send information of each attempt to unlock the trigger lock by fingerprint to the user device. The trigger lock may send alerts to the user device. The trigger lock also includes an alarm that produces alert when unauthorized personnel attempts to unlock the trigger lock.

14 Claims, 5 Drawing Sheets

BIOMETRIC FIREARM TRIGGER LOCK WITH ALARM

TECHNICAL FIELD

The present disclosure relates generally to trigger locks for firearms, and more particularly pertains to a trigger lock with biometric capability.

BACKGROUND

Firearm safety is an important issue. Violent crimes committed by using stolen firearms and accidental shootings such as by children using their parents' firearms are often reported in the news. Therefore, there is a need to secure the firearms such that unauthorized persons cannot easily use the firearms.

Currently there are certain methods for locking the firearm. For example, keyed or combination mechanical trigger locks are a commonly used method. However, like any mechanical lock, it may not be difficult for experienced persons to pick such locks. In addition, third party may obtain the key to the trigger lock to release the trigger lock. With respect to the combination locks, there are only limited combinations, which may not be too difficult to find the correct combination to unlock the trigger lock. The user may forger the combination after a period of time.

Another commonly used method is to secure the firearms in a locked firearm cabinet. However, in addition to the risks associated with lost keys and picked locks, this method prevents the firearms from being readily available in time of need.

Further, current trigger locks have a latch that is level or higher than the receptacle in which the lock rod is received such that the lock can be easily picked.

As such, there is a need for a secure mechanism for the firearms while providing authorized persons ready access to the firearms and is resistant to lock-picking.

SUMMARY

A firearm firing mechanism, i.e., trigger, protection lock with fingerprint recognition capabilities to unlock, and the trigger lock is operatively connectable to a user device to communicate therewith.

In some embodiments, the trigger lock system includes a trigger lock, which includes a first lock body and a second lock body. The first lock body includes a receptacle, and a latch. The latch is partially exposable inside the receptacle, and the top of the latch is lower than the opening of the receptacle. A latch bias member is disposed in the first lock body that biases the latch toward the receptacle. The second lock body includes a rod that is insertable in the receptacle and engageable with the latch such that the trigger lock is lockable.

In some embodiments, the first lock body includes a fingerprint reader that is configured to read fingerprint of a user. A main control unit is disposed in the first lock body, and the main control unit is operatively connected to the fingerprint reader. The main control unit is configured to store fingerprints, receive fingerprint from the fingerprint reader, and compare the fingerprint from the fingerprint reader with the stored fingerprints.

In some embodiments, the main control unit is operatively connected to an actuator control module that is disposed in the first lock body. The actuator control module is operatively connected to an actuator in the first lock body, and the actuator is operatively connected to the latch. A battery is also disposed in the first lock body, and the battery is operatively connected to the main control unit, the actuator, the fingerprint reader, and the actuator control module.

When the read fingerprint matches a stored fingerprint, the main control unit causes the actuator to move the latch to disengage the rod.

In some embodiments, the trigger lock includes a short-range wireless module, for example, a Bluetooth module. The short-range wireless module may be connectable to a short-range wireless gate-way, for example, a Bluetooth gateway, that is connectable to the internet.

In some embodiments, the trigger lock may also include a wireless communication module that enables the trigger lock to connect to the internet.

In some embodiments, the trigger lock and a user device are connected through a short-range wireless, for example, Bluetooth, or internet protocol, and the connection may switch therebetween.

In some embodiments, alerts may be sent to the user device from the trigger lock through the connection between the trigger lock and the user device. The alerts may include fingerprint read from by the fingerprint reader that does not match the stored fingerprints, the battery charge is below a predetermined level, or the battery is being charged.

In some embodiments, the trigger lock includes a battery control module that signals the main control module to produce an alert when the battery charge is below a predetermined level, or the battery is being charged.

In some embodiments, a command may be sent from the user device to the trigger lock to cause the trigger lock to unlock.

In some embodiments, the rod comprises a groove. A pusher and a bias member are disposed in the groove and the pusher is partially exposable from the groove. The bias member biases the pusher against the first lock body when the trigger lock is in a locked position. As such, when the trigger lock is unlocked, the pusher facilitates separation between the first lock body and the second lock body.

In some embodiments, the trigger lock also includes a mechanical lock mechanism so that the trigger lock can be opened with a key.

In another aspect of this disclosure, a method for using the trigger lock system is provided.

BRIEF DESCRIPTION OF THE DRAWINGS

The disclosure will be explained in more detail in the following with reference to embodiments and to the drawing in which are shown.

DESCRIPTION

In the following description, numerous specific details are set forth in order to provide a more thorough description of the present disclosure. It will be apparent, however, to one skilled in the art, that the present disclosure may be practiced without these specific details. Other embodiments of the disclosure will readily suggest themselves to such skilled persons having the benefit of this disclosure. In some instances, well-known features have not been described in detail so as not to obscure the disclosure.

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

The term "connected," "attached to" or similar expression may indicate that the elements are directly connected to each other or connected through other components.

Figure 1:
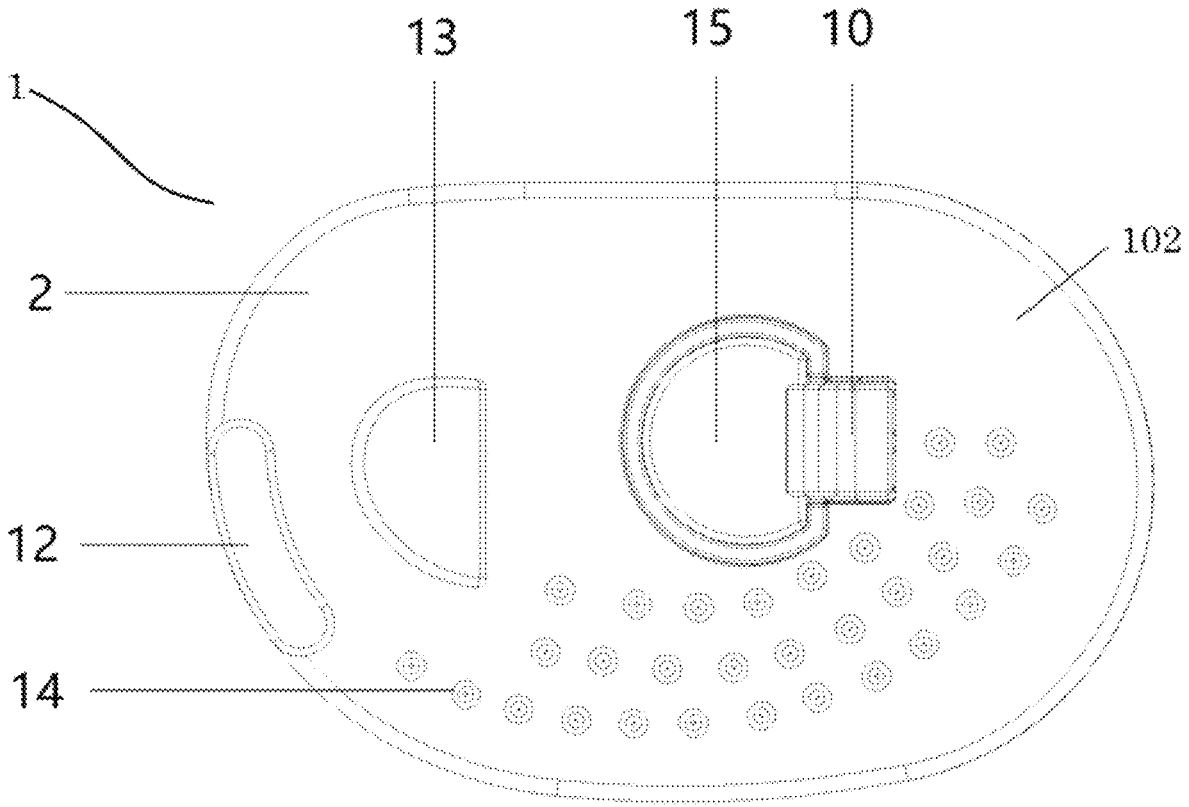
FIG. 1 shows a top view of one embodiment of the first lock body.
Figure 2:
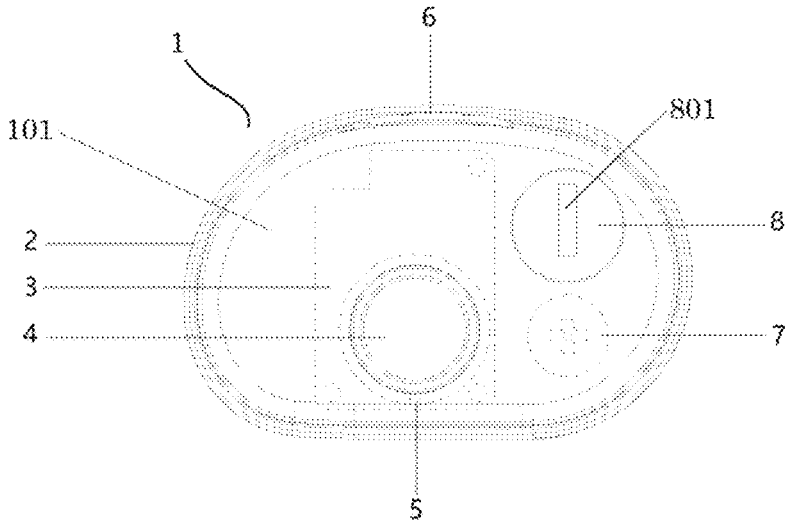
FIG. 2 shows a bottom view and partial sectional view of the first lock body of FIG. 1.
Figure 3:
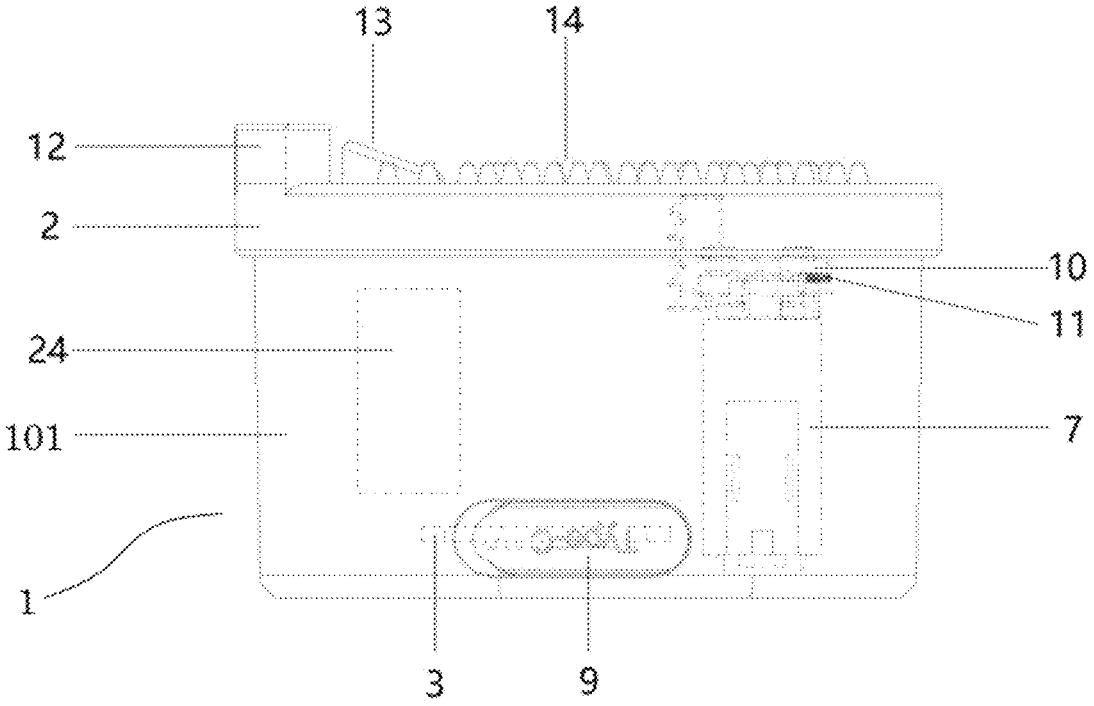
FIG. 3 shows a side view of the first lock body of FIG. 1.

Referring first to FIGS. 1, 2, and 3, which shows various views of the first lock body 1.

The first lock body 1 includes a protective layer 2, which may be made of rubber or elastomers. The protective layer 2 make it more difficult for water and debris to enter the inside of the lock.

A latch 10 is disposed in the receptacle 15, and the latch 10 can be seen from the top of the first lock body 1. The latch 10 is operatively connected to a bias member 11 that biases the latch 10 toward the interior of the receptacle 15. The bias member 11 is a spring. In some embodiments, the bias member may be other resilient member or structure.

A first positioner 12 and a second positioner 13 are disposed on the top surface 102 of the first lock body 1, both protruding from the top surface 102 of the first lock body 1. The first positioner 12 is disposed closer to the edge of the top surface 102 than the second positioner 13. For example, the first positioner 12 may be disposed on the edge of the top surface 102 of the first lock body 1. The second positioner 13 has a sloped surface to facilitate positioning. In some embodiments, the positioner 13 has a flat surface.

One or more resilient protrusions 14 are disposed on the top surface 102 of the first lock body.

A fingerprint reader 4 is disposed on the bottom of the first lock body 1. The fingerprint reader 4 is operatively connected to a controller 3 disposed in the housing 101 of the first lock body 1. The fingerprint reader 4 may be a semiconductor fingerprint sensor.

An LED indicator light 5 is disposed adjacent the fingerprint reader 4. For example, the LED indicator light 5 may be disposed around the fingerprint reader 4. The LED indicator light 5 is operatively connected to the controller 3.

An actuator 7 is disposed in the housing 101 of the first lock body 1. For example, the actuator may be a motor.

A mechanical key mechanism 8 is disposed in the housing 101 of the first lock body 1. The keyhole 801 is accessible from the bottom of the first lock body 1 such that the trigger lock may be opened in certain circumstances, for example, when the battery is depleted, preventing the user from unlocking the trigger lock by using fingerprint.

A USB port 9 is disposed on the side of the first lock body, which is operatively connected to the controller 3. The USB port may be in the form of Type-C, Micro USB or other form. The USB port 9 may be used to update the firmware of the controller 3.

The battery 24 is disposed in the housing 101 of the first lock body 1. The battery 24 is operatively connected to the USB port 9 for charging. In some embodiments, the battery 24 may be charged by induction charging.

The battery 24 is also operatively connected to the actuator 7 and the controller 3. The battery may be a rechargeable battery, for example, lithium, NiMH, or NiCad battery.

Figure 4:
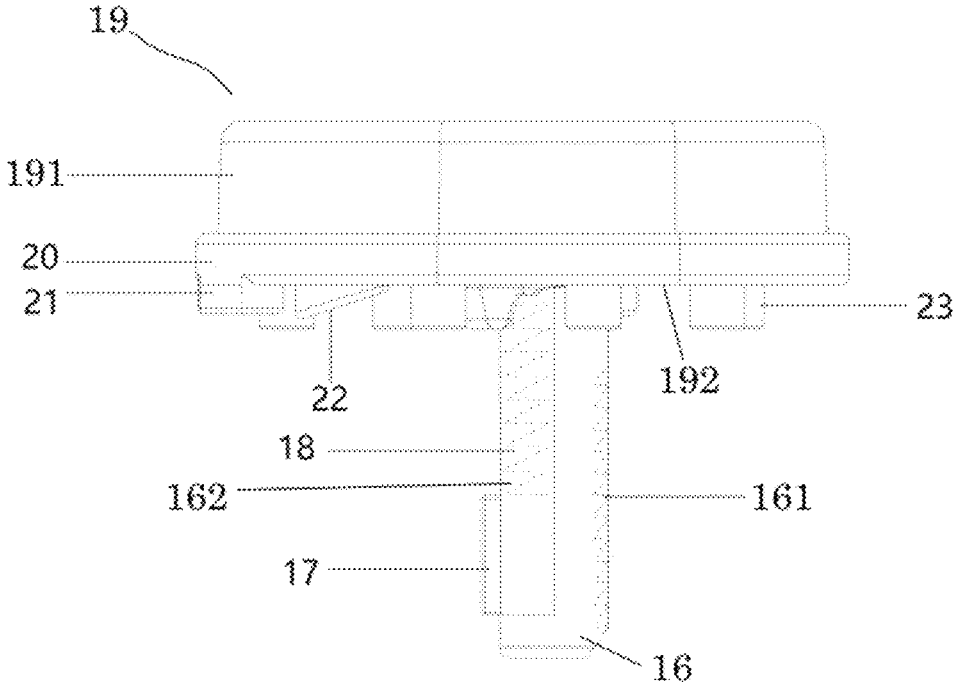
FIG. 4 shows a side view of one embodiment of the second lock body.
Figure 5:
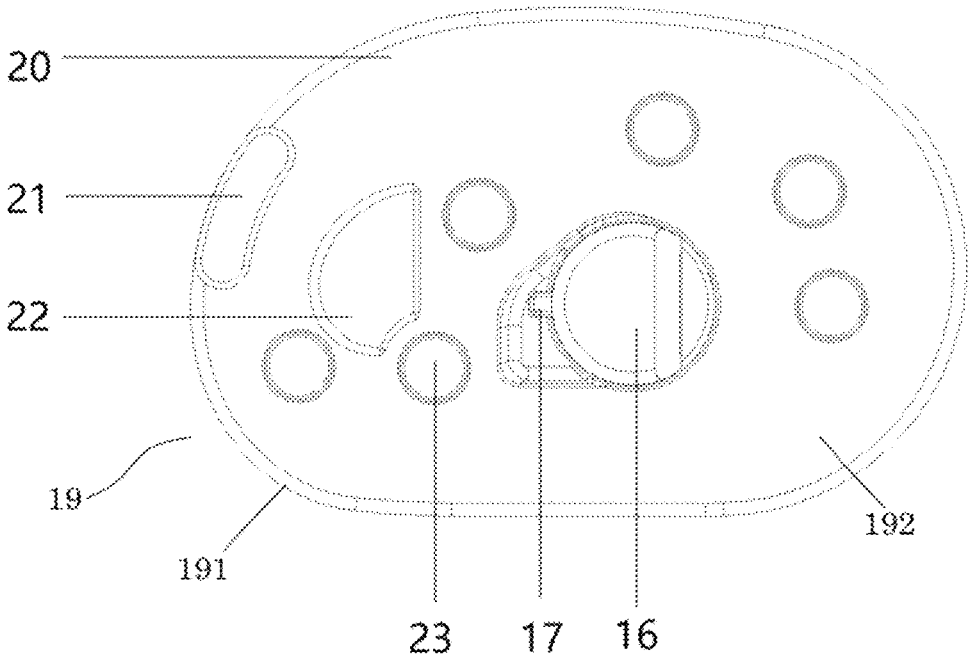
FIG. 5 shows a top view of the second lock body of FIG. 4.

Reference is now made to FIGS. 4 and 5.

The second lock body 19 includes a housing 191. A protective band 20 is disposed on the top surface 192 of the second locking body 19.

A lock rod 16 extends from the top surface 192 of the second lock body 19. Notches 161 are configured on the rod 16.

A groove 162 is configured on the side of the rod 16 away from the notches 161. A pusher 17 is disposed in the groove 162, and the pusher 17 is partially exposable from the rod 16. The pusher 17 is movable along the groover 162. The pusher 17 is operatively connected to a bias member 18 that biases the pusher 17 away from the housing 191 of the second lock body 19. In some embodiments, the bias member 18 is a spring.

An outer positioner 21 is disposed on the top side of the second lock body 19, which is in the form of a protrusion. An inner positioner 22 is disposed on the top surface 192 of the second lock body 19, which is in the form of a protrusion. The top of the inner positioner 22 is sloped. In some embodiments, the top of the inner positioner 22 is flat. The outer positioner 21 is closer to the edge of the top surface 192 of the second lock body 19 than the inner positioner 22.

Movable rods 23 are disposed in the housing 191 and the shafts are exposable from the top surface 192 of the second lock body 19.

Figure 6:
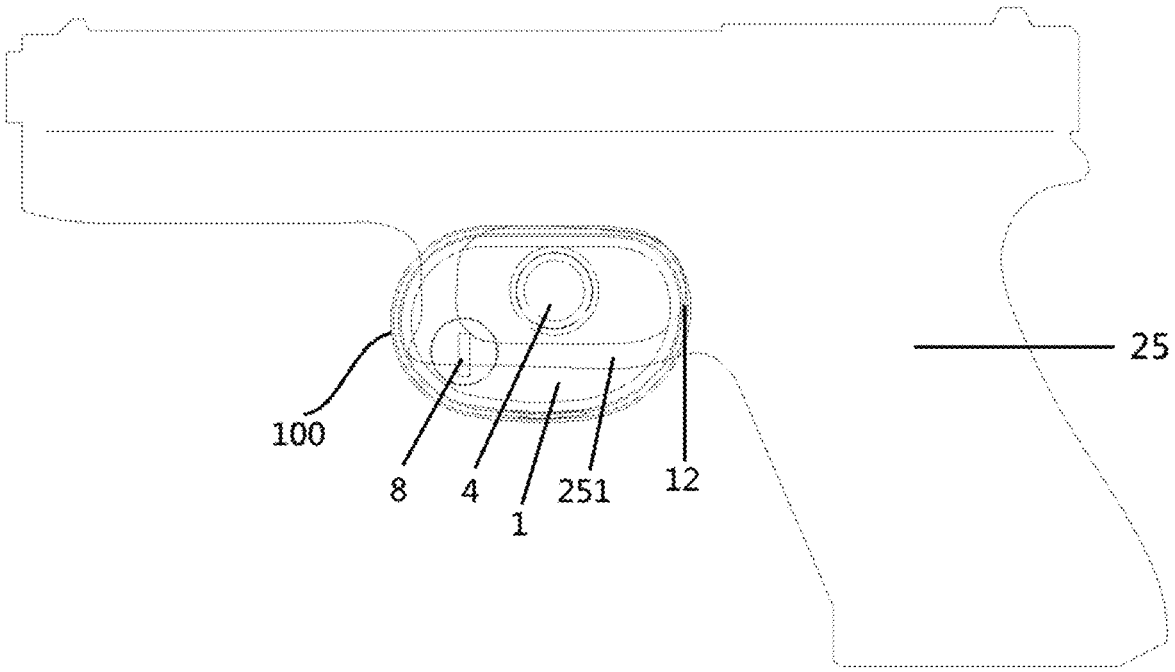
FIG. 6 shows a side view of one embodiment of the trigger lock attached to a handgun.

Reference is now made to FIG. 6, which illustrates the trigger lock 100 attached to the firearm 25.

When installed, the positioner 12 is positioned in front of the trigger guard 251.

Figure 7:
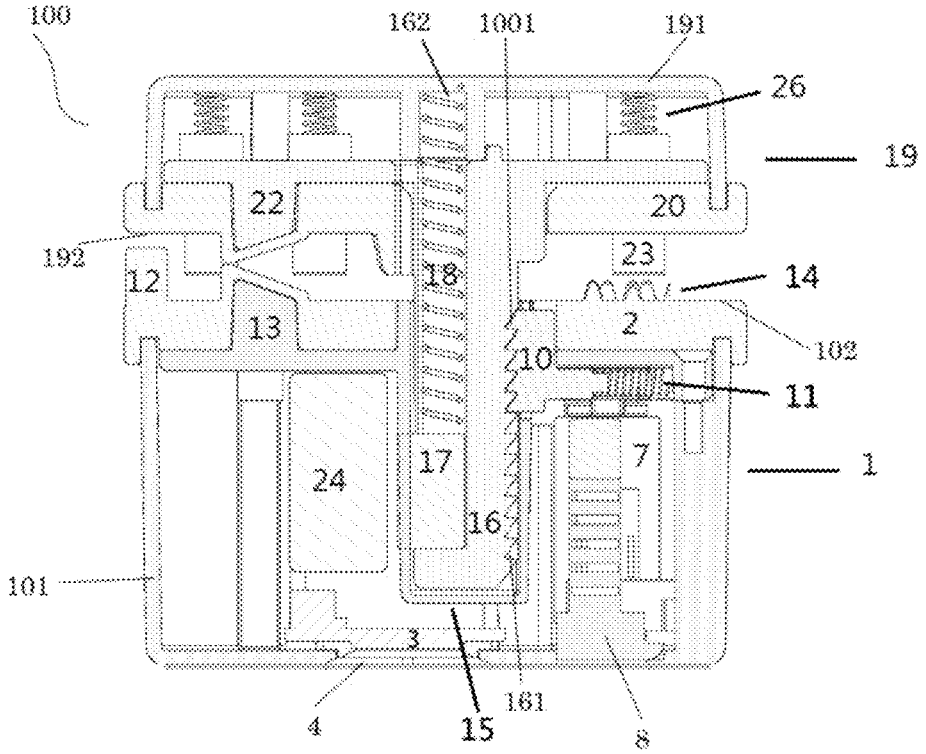
FIG. 7 shows a sectional view of the trigger lock in the locked position.

Reference is now made to FIG. 7, which shows a sectional view of the trigger lock in the locked position.

The rod 16 is inserted in the receptacle 15. The bias member 11 biases the latch 10 towards the rod 16 such that the teeth 1001 of the latch 10 engage the notches 161 of the rod 16 such that the trigger lock 100 is in the locked position. The rod 16 passes through the trigger guard 251 to prevent the trigger from being activated. To put the trigger lock 100 in the locked position, the lock rod 16 is pushed into the receptacle 15 and engages the latch 10.

The top of the latch 10 is disposed in the receptacle 15 below the top surface 102 of the first lock body 1, i.e., lower than the top opening of the receptacle 15. As such, foreign objects cannot be inserted in the receptacle 15 to push the latch 10 to pick the trigger lock 100.

The rod 16, notches 161 and the latch 10 may be adjusted such that the user can adjust how tight the trigger lock 100 is when the trigger lock 100 is in the locked position. For example, the resilience of the bias member 11 and the bias member 18, each independently, may be adjusted.

The top of the second positioner 13 is in contact with the top of the inner positioner 22. With the outer positioner 12 disposed in front of the trigger guard 251, the movement of trigger lock 100 relative to the trigger guard is limited.

The actuator 7 is operatively connected to the latch 10 such that it may withdraw the latch 10 from the rod 16.

The mechanical lock mechanism 8 is also operatively connected to the latch 10. When the key (not shown) is turned in the mechanical lock mechanism 8, the latch is withdrawn from the rod 16.

Bias members 26 are disposed in the housing 191 between the housing 191 and the movable rods 23, biasing the rods 23 away from the housing 191. As such, the rods 23 contact the sides of the trigger guard 251 of various shapes and sizes so that the trigger lock 100 is positioned to prevent access to the trigger.

Figure 8:
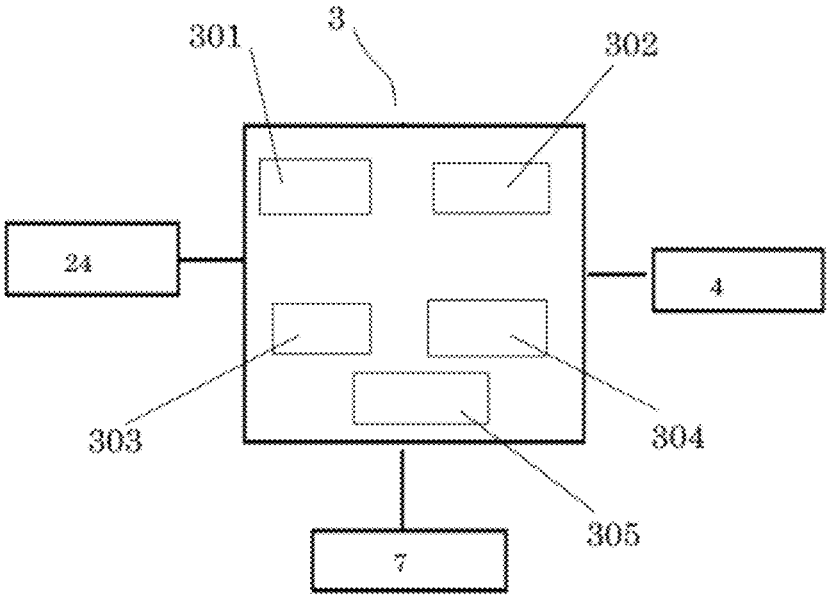
FIG. 8 illustrates one embodiment of the electrical and electronic components in the trigger lock.

Reference is now made to FIG. 8.

The controller 3 includes a main control unit (MCU) 301, a short-range wireless module 302, a wireless communication module 303, an actuator control module 304, and an alarm 305 configured to produce visual and/or audio alerts. For example, the alarm 305 may be a buzzer. In some embodiments, the wireless communication module 303 is a Thread communication module that is compliant to the Thread protocol. In some embodiments, the short-range wireless module 302 is a Bluetooth module.

The MCU 301 is configured to store fingerprints, compare scanned fingerprints with the stored fingerprints, and signal the appropriate module. The stored fingerprints may be from the fingerprint reader during the initial setup.

When the scanned fingerprint matches a stored fingerprint, the MCU 301 causes the actuator 7 to move the latch 10 so that unlock is effected. For example, when the actuator 7 is a motor, a shaft of the motor may rotate, causing the latch 10 to disengage from the rod 16.

The MCU 301 may be able to store fingerprints from multiple users.

The Bluetooth module 302 enables Bluetooth communication between the trigger lock 100 and the Bluetooth enabled devices, such as smartphones.

The wireless communication module 303 enables communication with other wireless communication-enabled devices. For example, the wireless communication module 303 may be compliant with the WIFI protocol for connecting with other WIFI-enabled devices.

The actuator control module 304 is operatively connected to the actuator 7 such that it can signal the actuator to move the latch 10 to unlock the trigger lock 100. The actuator control module 304 may also signal the actuator to release the force on the latch 10 such that the latch 10 would return to the locked position.

The alarm 305 is operatively connected to the main control unit 301 and produces alert when a predetermined condition is met. For example, when the MCU 301 recognizes that the scanned fingerprint does not match stored fingerprints. The alarm 305 is operatively connected to the LED indicator light 5 such that a visual alert may be provided by causing the LED indicator light 5 to flash a red light. The alarm 305 may also periodically produce audio signal when the charge of the battery 24 is lower than a predetermined level.

The controller 3 also includes a battery control module 306 to check the status of the battery 24 and control the battery 24. The battery control module 306 is operatively connected with the LED indicator light 5. When the battery charge is lower than a predetermined level, the battery control module 306 may cause the LED indicator light to provide a signal, for example, by producing a red light. When the battery 24 is being charged, the battery control module 306 may cause the LED indicator light 5 to provide a signal, for example, by flashing red light. A green light may also be provided by the LED indicator light 5 when the battery 24 is fully charged.

In some embodiments, the controller 3 also includes a WIFI module to enable WIFI communication with other devices.

Figure 9:
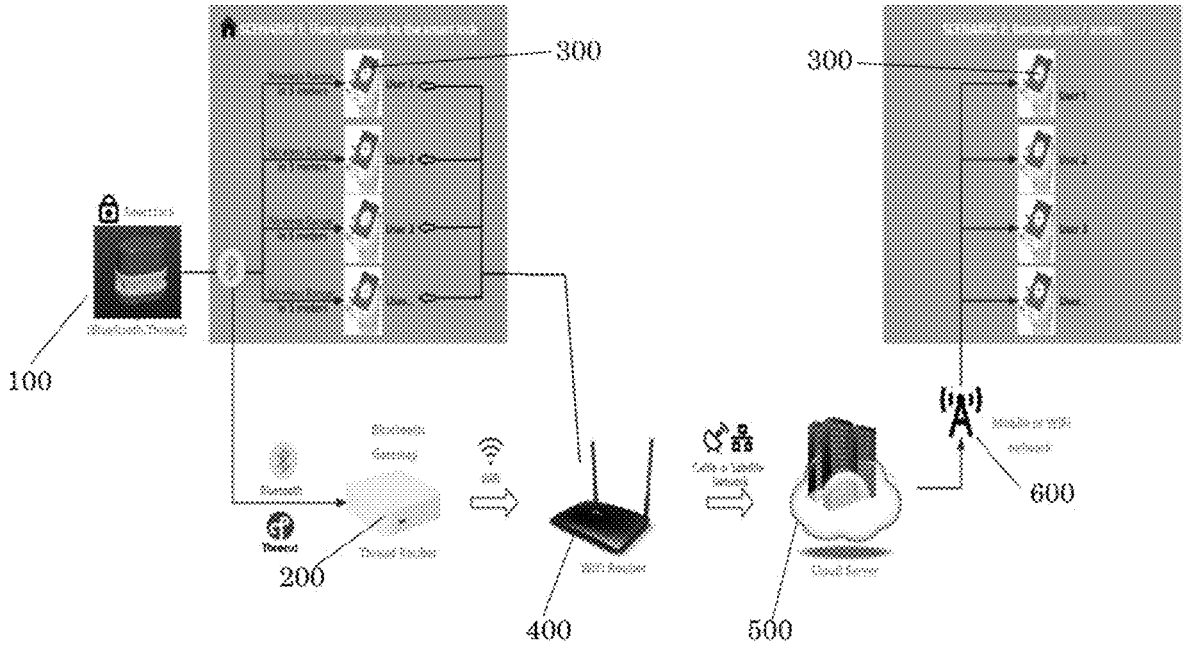
FIG. 9 illustrates the trigger lock as part of a networked system.

Reference is now made to FIG. 9, which shows the trigger lock 100 as a part of a network.

The Bluetooth module 302 enables the trigger lock 100 to be connected to a Bluetooth-enabled device 300 such as a smartphone in a certain range, for example, 5 meters. As such, the trigger lock 100 may be controlled from an authorized app on the device 300 by the authorized user. Alert may also be sent from the trigger lock 100 to the device 300.

When the Bluetooth-enabled device 300 is beyond a certain range from the trigger lock 100, the direct Bluetooth communication between the trigger lock 100 and the device 300 is lost. The trigger lock 100 then communicates with a Bluetooth gateway and/or a Thread router 200, which is in turn connected to a WIFI router that communicates with the internet, such that the trigger lock 100 connects to a user device 300 such as a smartphone. The user then can control the trigger lock 100 from the user device 300, for example, from an app on a smartphone. Alerts may also be sent from the trigger lock 100 to the device 300.

When the trigger lock 100 and the user device 300 are not connected, the main control module 301 stores events and alerts and transmits such events and alerts to the user device 300 next time the trigger lock 100 and the user device 300 are connected.

The connection between the trigger lock 100 and the user device 300 may also enable a message or to be sent to the user device 300 when the battery level is lower than a predetermined level.

A method for using the trigger lock 100 is also provided.

Before the first use of the trigger lock 100, the authorized user has the fingerprint reader 4 read the fingerprints of the desired fingers, and the fingerprints are stored in the MCU 301 of the controller 3. Multiple fingerprints from multiple users may be stored in the MCU 301. In some embodiments, the fingerprints may be read at the user device 300 and transmitted from the user device 300 to the MCU 301 to be stored there.

In some embodiments, the trigger lock 100 is connected to the device 300, for example, by Bluetooth and/or the internet, and the settings of the trigger lock 100 may be managed from an app on the device 300. For example, the stored fingerprints, authorized users, the time period during which the trigger lock 100 may be unlocked, and other functions may be managed from the app on the device 300. In addition, by joining the network, the trigger lock 100 becomes a part of the Internet of Things (IOT), and smart functions may be provided through the interactions between the trigger lock 100 and the network.

After setting up the trigger lock 100, only authorized fingerprints or the authorized users may unlock the trigger lock 100.

When the user intends to unlock the trigger lock 100, the user puts the finger on the fingerprint reader 4. The scanned fingerprint is sent to the MCU 301 of the controller 3. If the scanned fingerprint matches a fingerprint stored in the MCU 301, the MCU 301 signals the actuator control module 304, which causes the actuator 7 to move the latch 10 away from the rod 16 such that the trigger lock 100 is unlocked. The bias member 18 pushes the pusher 17, which pushes against the first lock body 1, thus facilitating the separation of the first lock body 1 and the second lock body 19.

When the MCU 301 determines that the scanned fingerprint matches a fingerprint stored in the MCU 301, the MCU 301 may cause the LED indicator light 5 to light up, for example, in green.

If a scanned fingerprint does not match a stored fingerprint, the trigger lock 100 remains locked. The alarm 305 will produce alerts and an alert will be sent from the MCU 301 of the trigger lock 100 to the user device 300, either by Bluetooth when the device 300 and the trigger lock 100 are in the predetermined range or through the internet when the trigger lock 100 and the device 300 are beyond the predetermined range.

In some embodiments, the user may issue an unlock command from an app on the device 300, and the command is transferred to the MCU 301, which causes the trigger lock 100 to unlock by movement of the actuator 7 as described earlier.

After the first lock body 1 and the second lock body 19 are separated, the actuator 7 releases the force applied on the latch 10 such that the latch 10 is biased by the bias member 11 to return to the locking position, ready to engage the rod 16 again.

In some embodiments, the MCU 301 will log each instance that a fingerprint is read, for example, for later identifying the person who attempted to unlock the trigger lock 100. The MCU 301 may also transfer information about each attempt to unlock the trigger lock to the app on the device 300 so that a record is created and kept.

In some embodiments, the MCU 301 may be configured to issue an alert to the app on the device 300 when a fingerprint is read that does not match the fingerprints stored in the MCU 301 for a predetermined number of times in a predetermined period of time, for example, three or five times in two minutes. When the device 300 is not connected to the trigger 100, for example, when one of trigger lock 100 or the device 300 is offline or out of range of each other, the MCU 301 retains the information and transfers the information to the device 300 when they are connected next time. The MCU may also cause the alarm 305 to produce audio and/or visual alerts.

As a part of the IOT, smart functions may be provided. For example, when the trigger lock 100 and the device 300 are in the same residence, the trigger lock 100 and the device 300 are connected by Bluetooth or local network such that the alert may be sent to the device 300 from the trigger lock 100, or the trigger lock may be unlocked by sending the command from an app on the device 300. When the device 300 and the trigger lock 100 are not in the same residence, the trigger lock 100 and send the alert and/or records to the device 300 or receive instructions from the device 300 by the connection through a mobile or WIFI network 600 by the Bluetooth gateway or Thread router 200 that is connected to the internet through a WIFI router 400, cloud server 500.

In certain circumstances, for example, when the battery 24 is depleted, the trigger lock 100 may be unlocked using a key through the mechanical lock mechanism 8. A key inserted in the keyhole 801 is rotated, causing the latch 10 to disengage from the rod 16 such that the trigger lock 100 is unlocked.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A trigger lock system, comprising:

a trigger lock, comprising:

a first lock body, comprising a receptacle;

a latch disposed in the first lock body, the latch is at least partially exposable in the receptacle, and a top of the latch is lower than an opening of the receptacle;

a latch bias member that biases the latch toward the receptacle; and a second lock body, comprising a rod that is insertable in the receptacle and engageable with the latch such that the trigger lock is lockable;

a fingerprint reader disposed on the first lock body configured to read a fingerprint of a user;

a main control unit disposed in the first lock body, the main control unit is operatively connected to the fingerprint reader, the main control unit is configured to store fingerprints, receive a read fingerprint from the fingerprint reader, and compare the read fingerprint with the stored fingerprints;

an actuator disposed in the first lock body, wherein the actuator is operatively connected to the latch;

an actuator control module operatively connected to the main control unit and the actuator; and a battery operatively connected to the fingerprint reader, the main control unit, the actuator, and the actuator control module;

wherein the main control unit causes the actuator to move the latch to disengage from the rod when the read fingerprint matches a stored fingerprint.

2. The trigger lock system of claim 1, wherein the trigger lock is operatively connectable to a user device by a short-range wireless protocol or an internet; and wherein a connection between the user device and the trigger lock switches to the internet when the user device and the trigger lock is out of the range of a short-range wireless connection; and the connection switches to the short-range wireless connection when the user device and the trigger lock is within the range of the short-range wireless connection.

3. The trigger lock system of claim 2, wherein the trigger lock comprises a short-range wireless module.

4. The trigger lock system of claim 3, further comprising a short-range wireless gateway that is connectable to the internet.

5. The trigger lock system of claim 2, wherein the trigger lock comprises a wireless communication module that enables the trigger to connect to the internet.

6. The trigger lock system of claim 2, wherein the main control unit causes an alert to be produced when the read fingerprint does not match the stored fingerprints for a predetermined number of times in a predetermined period of time, when a charge of the battery is lower than a predetermined level, or when the battery is being charged.

7. The trigger lock system of claim 6, wherein the trigger lock further comprises a battery control module operatively connected to the main control unit, and the battery control module transmits a signal to the main control unit such that the alert is produced when the change of the battery is lower than a predetermined level, or when the battery is being charged.

8. The trigger lock system of claim 7, wherein the alert audio and/or visual.

9. The trigger lock system of claim 7, wherein the alert and/or the battery alert is sent to the user device connected with the trigger lock.

10. The trigger lock system of claim 7, wherein the main control unit stores the alert and the battery alert, and transmits the alert and the battery alert to the user device when the trigger lock and the user device are connected.

11. The trigger lock system of claim 2, wherein the main control unit collects information about each attempt to unlock the trigger lock by reading a fingerprint and transmits the information to the user device when the trigger lock is connected to the user device.

12. The trigger lock system of claim 2, wherein a command to unlock the trigger lock is transmittable from the user device to the main control unit, causing the trigger lock to be unlocked.

13. A trigger lock system, comprising a trigger lock, comprising:

a first lock body, comprising a receptacle;

a latch disposed in the first lock body, the latch is at least partially exposable in the receptacle, and a top of the latch is lower than an opening of the receptacle;

a latch bias member that biases the latch toward the receptacle; and a second lock body, comprising a rod that is insertable in the receptacle and engageable with the latch such that the trigger lock is lockable;

wherein the rod comprises a groove, in which a pusher and a bias member are disposed, the pusher is partially exposable from the groove and the bias member biases the pusher away from a housing of the second lock body, and the pusher pushes against the first lock body when the trigger lock is in a locked position such that a separation of the first lock body and the second lock body is facilitated when the trigger lock is unlocked.

14. The trigger lock system of claim 1, further comprising a mechanical lock mechanism such that the lock is openable with a key.

* * * * *